US011547914B2

(12) United States Patent
Rause

(10) Patent No.: US 11,547,914 B2
(45) Date of Patent: Jan. 10, 2023

(54) SYSTEMS AND METHODS OF CONVERTING A CORNHOLE GAME TO A HORSESHOE GAME

(71) Applicant: Thomas A. Rause, Zebulon, NC (US)

(72) Inventor: Thomas A. Rause, Zebulon, NC (US)

( * ) Notice: Subject to any disclaimer, the term of this patent is extended or adjusted under 35 U.S.C. 154(b) by 0 days.

(21) Appl. No.: 15/931,460

(22) Filed: May 13, 2020

(65) Prior Publication Data

US 2020/0360783 A1 Nov. 19, 2020

Related U.S. Application Data

(60) Provisional application No. 62/846,808, filed on May 13, 2019.

(51) Int. Cl.
*A63B 67/06* (2006.01)

(52) U.S. Cl.
CPC ..... *A63B 67/06* (2013.01); *A63B 2067/063* (2013.01)

(58) Field of Classification Search
CPC ..... A63B 67/06; A63B 2067/063; A63B 2225/605; A63F 9/00
See application file for complete search history.

(56) References Cited

U.S. PATENT DOCUMENTS 163,845 A * 6/1875 Browne ..... A63B 67/06 273/338
1,616,236 A * 2/1927 Schacht ..... A63F 9/0208 273/336
2,204,078 A * 6/1940 Ferrary ..... A63F 9/02 273/336
2,490,409 A * 12/1949 Brown ..... A63B 69/3655 473/139
3,114,556 A * 12/1963 Miller ..... A63B 57/357 473/185
3,653,666 A * 4/1972 Barlow ..... A63F 7/0023 273/126 R
3,732,845 A * 5/1973 Istre ..... G09F 17/00 116/173
3,815,915 A * 6/1974 Chapman ..... A63F 9/0208 273/338
3,953,031 A * 4/1976 Kinser ..... A63B 67/06 273/336
D251,863 S * 5/1979 Gordon ..... D21/790
4,198,048 A * 4/1980 Rathert ..... A63B 67/06 273/339

(Continued)

*Primary Examiner* — Melba Bumgarner
*Assistant Examiner* — Amir A Klayman
(74) *Attorney, Agent, or Firm* — Kaufman & Canoles, P.C.

(57) ABSTRACT

Systems and methods of converting a cornhole game to a horseshoe game are provided. In one exemplary embodiment, a horseshoe apparatus that is operable to be disposed in a bag receiving hole in an inclined platform of a cornhole apparatus comprises inner and outer bases with each base having upper and lower surfaces. The apparatus further includes a coupling mechanism having first and second ends, wherein the coupling mechanism is coupled to the lower surface of the inner base such that the first end is positioned to extend outside a perimeter of the inner base and the second end is positioned within the perimeter of the inner base. The apparatus also includes a stem disposed through and at a center of the outer base. The stem is operable to deflect or catch an object tossed towards the stem.

20 Claims, 11 Drawing Sheets

(56) References Cited

U.S. PATENT DOCUMENTS 4,203,592 A * 5/1980 Quatkemeyer ..... A63B 67/06 273/336
D266,678 S * 10/1982 Herrmann ..... D21/304
4,392,653 A * 7/1983 Blume, Sr. ..... A63B 67/06 273/400
4,691,922 A * 9/1987 Peel ..... A63B 57/357 473/188
4,726,591 A * 2/1988 Johnson ..... A63B 67/06 273/338
4,736,955 A * 4/1988 Pollock ..... A63B 67/06 273/336
4,830,371 A * 5/1989 Lay ..... A63B 69/0091 248/516
4,938,485 A * 7/1990 Hockridge ..... A63F 9/02 273/354
4,982,966 A * 1/1991 Teafatiller ..... A63B 67/06 273/336
5,052,693 A * 10/1991 Hicks ..... A63F 9/0204 273/336
5,120,063 A * 6/1992 Birchler ..... A63B 57/357 473/180
5,246,226 A * 9/1993 McGuinn ..... A63B 69/0079 473/429
5,533,734 A * 7/1996 Husk ..... A63B 67/06 273/402
5,540,181 A * 7/1996 Pearce ..... G09F 17/00 116/173
5,620,185 A * 4/1997 Robertson ..... A63B 67/06 273/338
5,766,086 A * 6/1998 Folsom ..... A63B 67/02 473/196
5,967,910 A * 10/1999 Lin ..... A63B 69/0075 473/417
6,672,970 B2 * 1/2004 Barlow ..... A63B 69/3661 473/162
6,672,971 B2 * 1/2004 Barlow ..... A63B 69/3661 473/162
6,793,586 B2 * 9/2004 Barlow ..... E04F 15/10 473/162
6,805,639 B2 * 10/2004 Maruszczak ..... A63B 57/40 473/190
7,134,662 B2 * 11/2006 Menendez ..... A63B 67/06 273/400
7,607,666 B1 10/2009 Studier
8,162,318 B1 * 4/2012 Peterson ..... A63B 67/06 273/402
8,177,185 B2 * 5/2012 Priegel ..... G09F 17/00 248/539
8,287,406 B2 * 10/2012 Biederman ..... A63B 63/00 473/470
8,821,322 B1 * 9/2014 Jorgens ..... A63B 69/0075 473/417
10,166,451 B1 * 1/2019 Laskowitz ..... A63B 67/06
10,544,934 B1 * 1/2020 Kennedy ..... F21V 15/04
2002/0175469 A1 * 11/2002 Kessler, Jr. ..... A63B 67/06 273/400
2003/0036446 A1 * 2/2003 Udwin ..... A63B 69/0075 473/417
2007/0092333 A1 * 4/2007 Viscount ..... A63C 19/062 403/349
2008/0029963 A1 * 2/2008 Cornfield ..... A63B 67/06 273/336
2008/0116644 A1 * 5/2008 Knoernschild ..... A63B 67/06 273/336
2008/0237990 A1 * 10/2008 Litz ..... A63B 67/06 273/400
2009/0312123 A1 * 12/2009 Liao ..... A63B 69/0002 473/417
2010/0181726 A1 * 7/2010 Bos ..... A63B 67/06 273/336
2012/0196691 A1 * 8/2012 Maclean ..... A63B 57/357 473/172
2016/0151692 A1 * 6/2016 Rexwinkel ..... A63B 67/06 273/336
2016/0201885 A1 * 7/2016 Rood ..... F21L 4/08 362/183
2018/0318684 A1 * 11/2018 Robinson ..... A63B 71/0672
2019/0183274 A1 * 6/2019 Peters ..... A47G 33/004

* cited by examiner

SYSTEMS AND METHODS OF CONVERTING A CORNHOLE GAME TO A HORSESHOE GAME

CROSS REFERENCE TO RELATED APPLICATIONS

This applications claims the benefit of U.S. Prov. App. No. 62/846,808, filed May 13, 2019, which is hereby incorporated by reference as if fully set forth herein.

FIELD OF DISCLOSURE

The present disclosure relates generally to the field of games, and in particular to systems and methods of converting a cornhole game to a horseshoe game.

BACKGROUND

Various lawn toss games and associated playing devices are described in the prior art. One such game is horseshoes in which players take turns throwing sets of horseshoes at stakes in the ground, which are traditionally placed forty feet apart. A horseshoe tossed near a stake will score a point while a horseshoe tossed around or on a post scores even more points. Another game is cornhole in which players take turns throwing sets of bags of corn at a raised platform with a hole in the upper end of the platform. A bag tossed onto the platform scores a point while a bag tossed into the hole scores more points. Play continues until a player or team reaches at least twenty-one points. While horseshoes and cornhole continue to be very popular lawn toss games, each game requires different playing devices and set-ups. Accordingly, there is a need for playing horseshoes and cornhole using the same or similar playing devices and set-ups so as to reduce set-up time and cost of the playing devices and enable the re-use of the same field of play. In addition, other desirable features and characteristics of the present disclosure will become apparent from the subsequent detailed description and embodiments, taken in conjunction with the accompanying figures and the foregoing technical field and background.

The Background section of this document is provided to place embodiments of the present disclosure in technological and operational context, to assist those of skill in the art in understanding their scope and utility. Unless explicitly identified as such, no statement herein is admitted to be prior art merely by its inclusion in the Background section.

SUMMARY

The following presents a simplified summary of the disclosure in order to provide a basic understanding to those of skill in the art. This summary is not an extensive overview of the disclosure and is not intended to identify key/critical elements of embodiments of the disclosure or to delineate the scope of the disclosure. The sole purpose of this summary is to present some concepts disclosed herein in a simplified form as a prelude to the more detailed description that is presented later.

Briefly described, embodiment of the present disclosure relate to systems and methods of converting a cornhole game to a horseshoe game. According to one aspect, a horseshoe apparatus that is operable to be disposed in a bag receiving hole in an inclined platform of a cornhole apparatus so as to couple the horseshoe apparatus to the cornhole apparatus to enable a horseshoe game comprises an outer base having upper and lower surfaces. A diameter or dimensions of the outer base is greater than a diameter or dimensions of the hole so that the outer base is operable to be positioned over the hole and on a portion of the inclined platform. The apparatus also includes an inner base having upper and lower surfaces. The upper surface of the inner base is centrally coupled to the lower surface of the outer base, with a diameter or dimensions of the inner base being no more than the diameter or dimensions of the hole and a depth of the inner base being at least a depth of the hole. Further, the apparatus includes a coupling mechanism having first and second ends. The coupling mechanism is coupled to the lower surface of the inner base such that the first end is positioned to extend outside a perimeter of the inner base and the second end is positioned within the perimeter of the inner base. In addition, the apparatus includes a stem is disposed through and at a center of the outer base, wherein the stem is operable to deflect or catch an object tossed towards the stem.

According to another aspect, each of the outer and inner bases has a shape of a cylinder.

According to another aspect, the stem has a shape of a cylinder.

According to another aspect, the stem is further disposed through and at a center of the inner base.

According to another aspect, the stem is further disposed through the coupling mechanism.

According to another aspect, the coupling mechanism is a shape of a rectangular prism.

According to another aspect, the perimeter of the upper base has a beveled edge. Further, an angle of that beveled edge is no more than forty-five degrees.

According to another aspect, the first end of the coupling mechanism has a beveled edge. Further, an angle of that beveled edge is forty-five degrees.

According to one aspect, a method of installing a horseshoe apparatus in a bag receiving hole in an inclined platform of a cornhole apparatus to enable the playing of horseshoes comprises positioning the horseshoe apparatus over the hole. The horseshoe apparatus includes an outer base having upper and lower surfaces, with a diameter or dimensions of the outer base being greater than a diameter or dimensions of the hole so that the outer base is operable to be positioned over the hole and on a portion of the inclined platform. The horseshoe apparatus also includes an inner base having upper and lower surfaces. The upper surface of the inner base is centrally coupled to the lower surface of the outer base, with a diameter or dimensions of the inner base being no more than the diameter or dimensions of the hole and a depth of the inner base being at least a depth of the hole. Further, the horseshoe apparatus includes a coupling mechanism having first and second ends. The coupling mechanism is coupled to the lower surface of the inner base such that the first end is positioned to extend outside a perimeter of the inner base and the second end is positioned within the perimeter of the inner base. In addition, the horseshoe apparatus includes a stem disposed through and at a center of the outer base. The stem is operable to deflect or catch an object tossed towards the stem. The method further includes tilting and moving the horseshoe apparatus towards the hole so that a portion of the coupling mechanism that extends beyond a perimeter of the lower base is disposed in the hole. The method also includes positioning the horseshoe apparatus in the hole so that the upper base is positioned over the hole and on a portion of the inclined platform while the inner base is disposed in the hole and the portion of the coupling mechanism that extends beyond the perimeter of the lower base is proximate and parallel to a bottom surface of the inclined platform.

BRIEF DESCRIPTION OF THE DRAWINGS

The present disclosure will now be described more fully hereinafter with reference to the accompanying drawings, in which embodiments of the disclosure are shown. However, this disclosure should not be construed as limited to the embodiments set forth herein. Rather, these embodiments are provided so that this disclosure will be thorough and complete, and will fully convey the scope of the disclosure to those skilled in the art. Like numbers refer to like elements throughout.

FIGS. 1A-D are perspective, side, top, and bottom views of the system, respectively. FIG. 1E illustrates the installation of the horseshoe apparatus into the cornhole apparatus.

FIGS. 2A-E are perspective, side, top, bottom, and exploded views of the horseshoe apparatus, respectively.

FIGS. 3A-C are perspective, side, top view (bottom view same as top view) of the bag assembly, respectively. FIG. 3D is a cross-sectional view of the bag assembly.

DETAILED DESCRIPTION

Figure 1A:
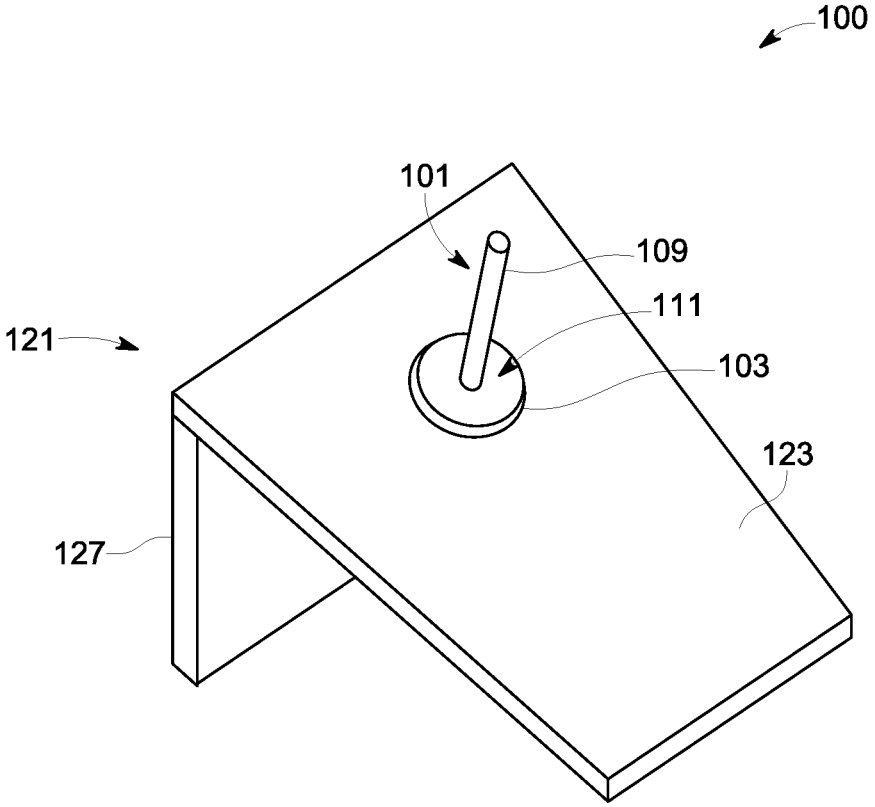
FIGS. 1A-E illustrate one embodiment of a system having a horseshoe apparatus and a cornhole apparatus for playing a horseshoe game in accordance with various aspects as described herein.
Figure 1B:
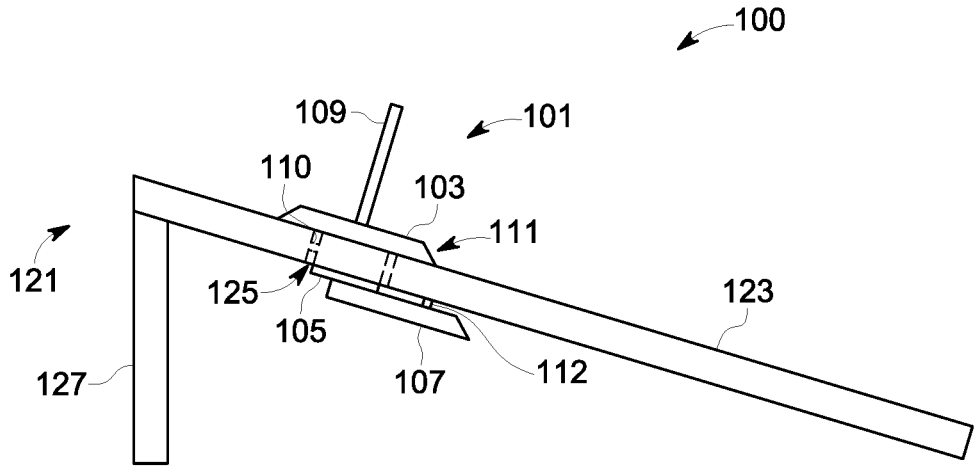
Figure 1C:
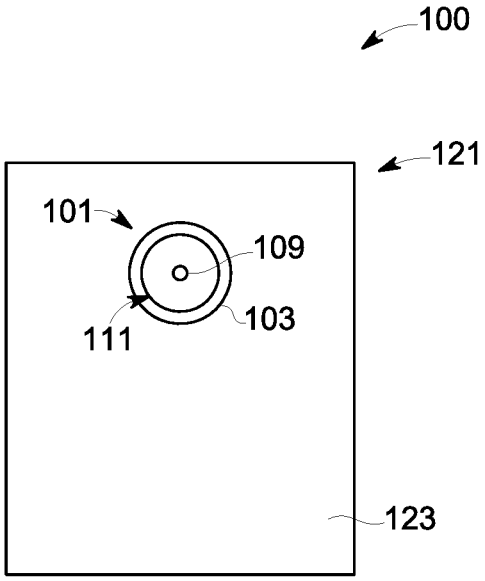
Figure 1D:
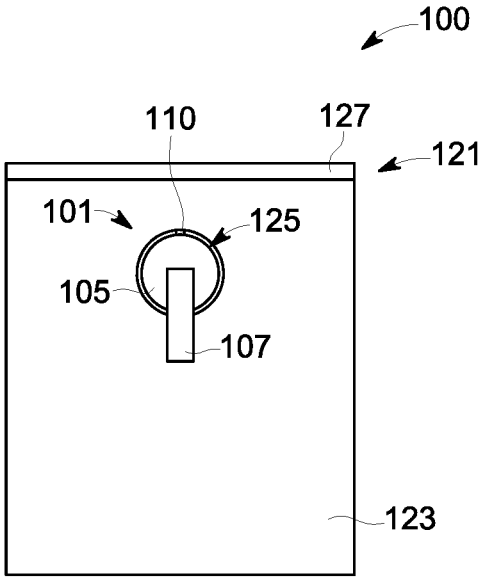
Figure 1E:
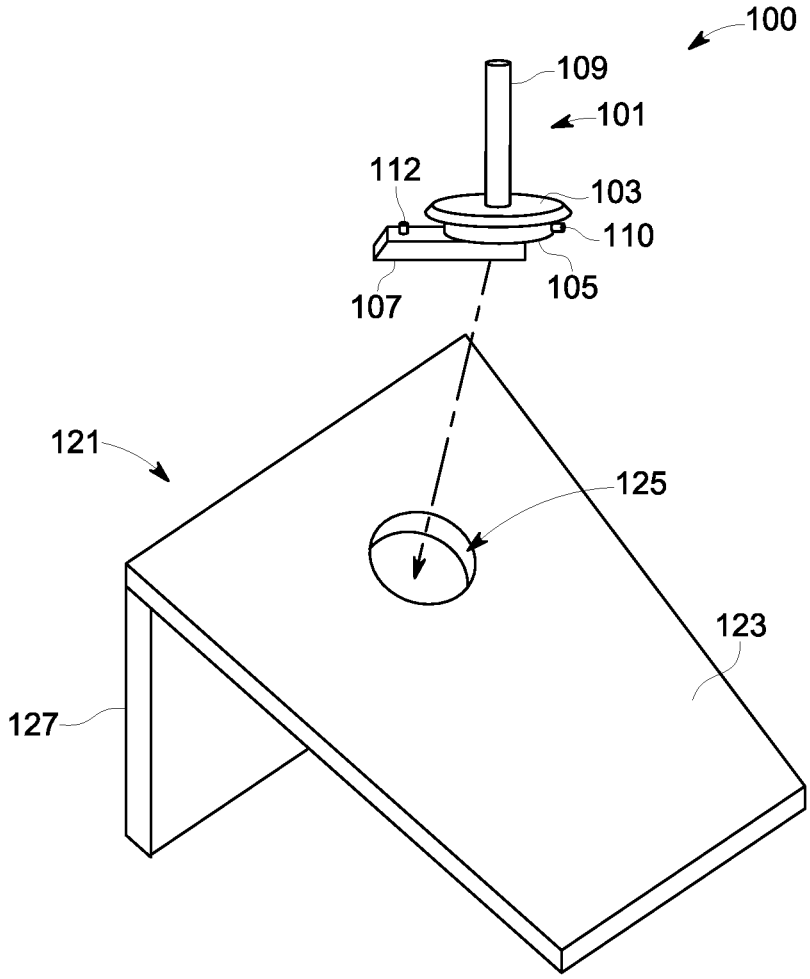
Figure 2A:
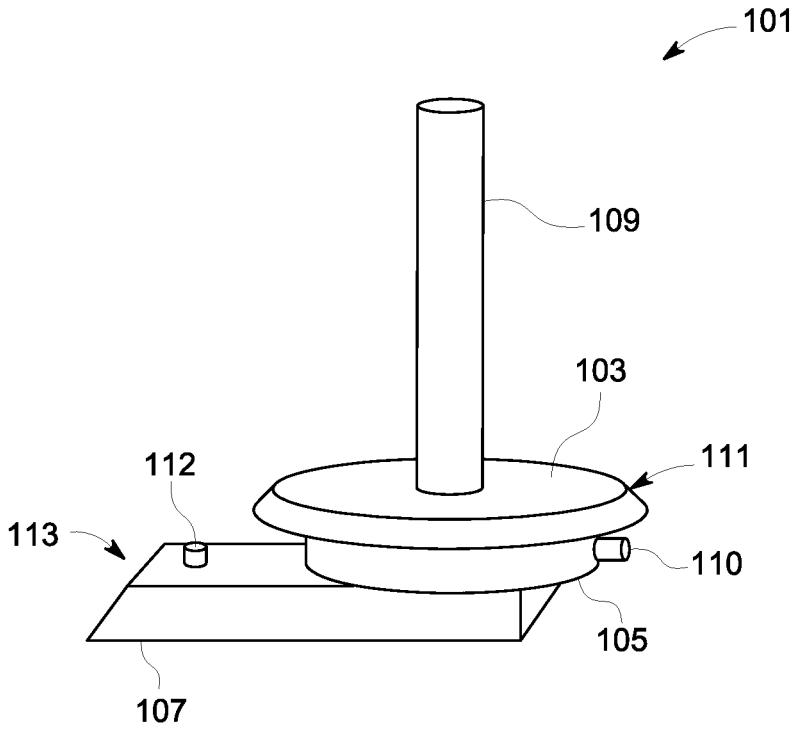
FIGS. 2A-E illustrate the horseshoe apparatus of FIGS. 1A-E.
Figure 2B:
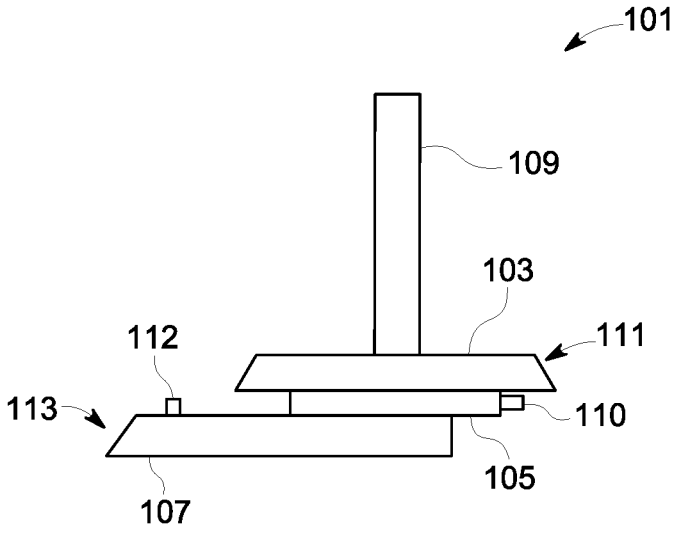
Figure 2C:
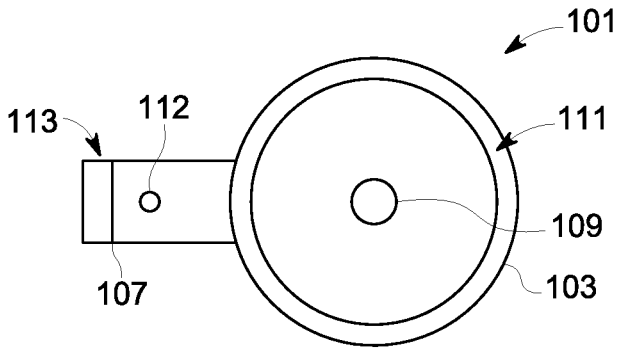
Figure 2D:
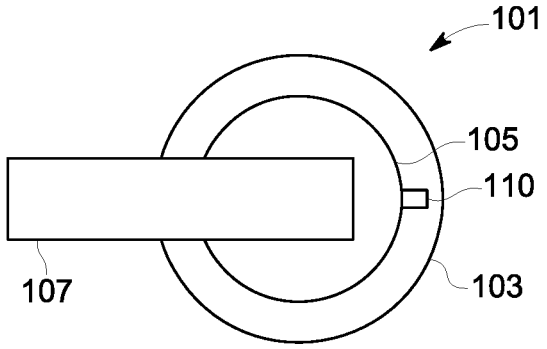
Figure 2E:
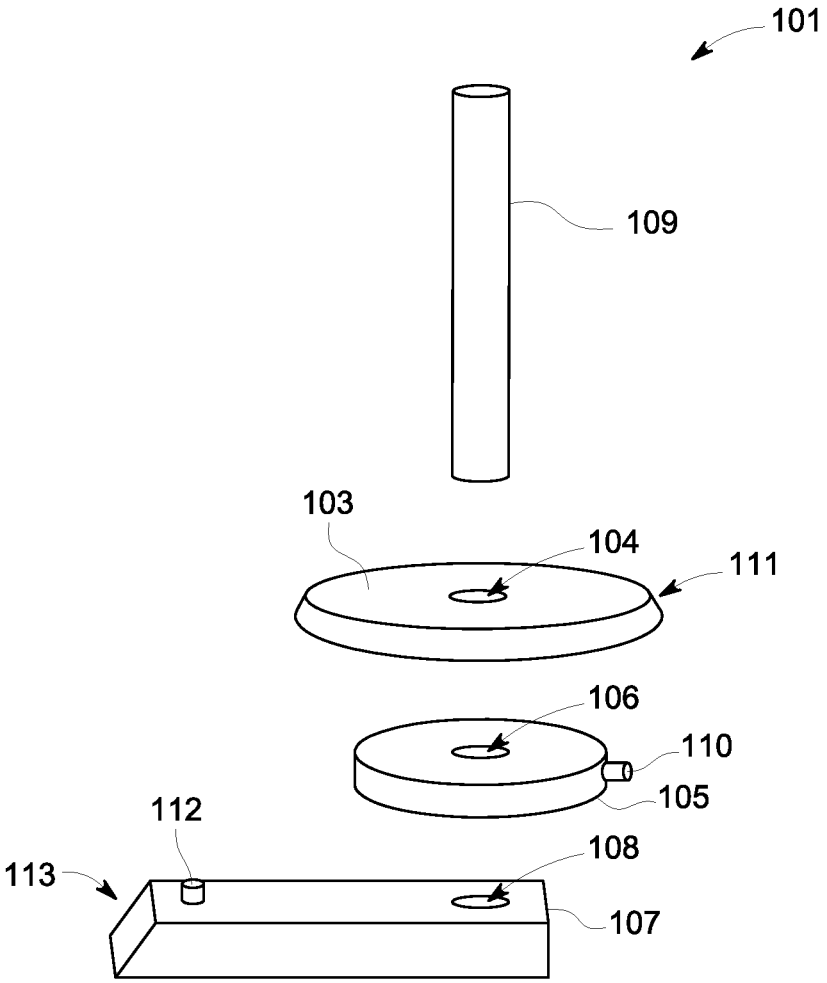
Figure 3A:
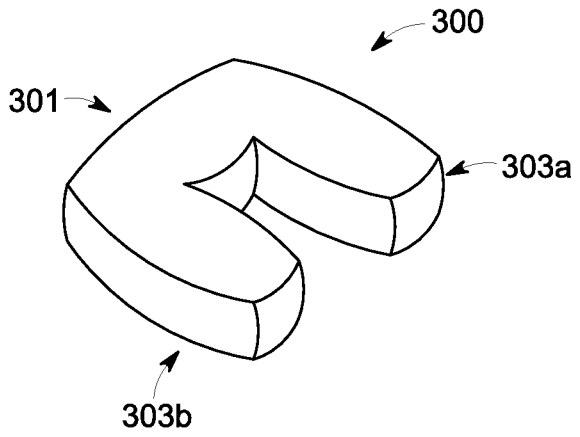
FIGS. 3A-D illustrate one embodiment of a horseshoe bag assembly in accordance with various aspects as described herein.
Figure 3B:
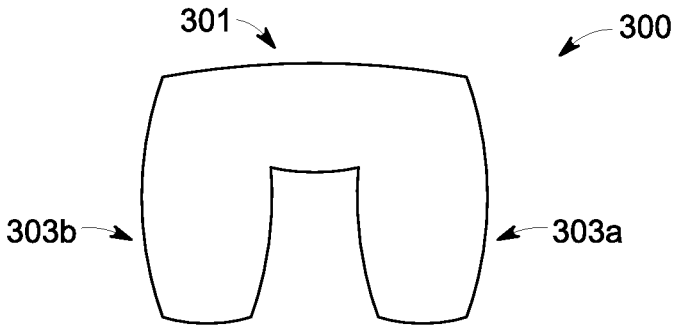
Figure 3C:
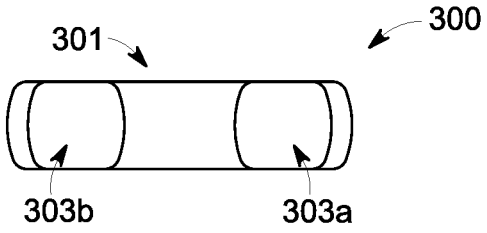
Figure 3D:
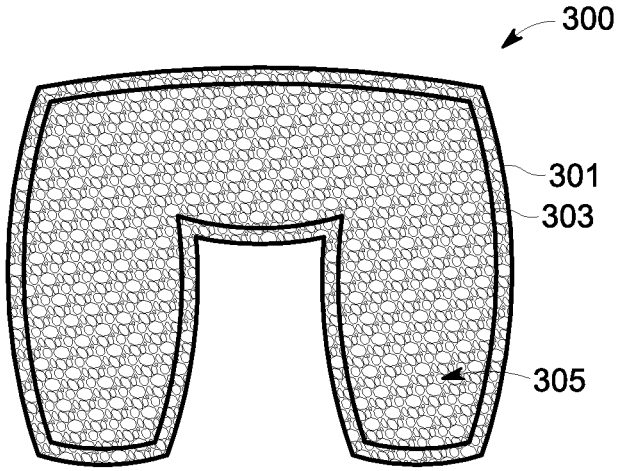

For simplicity and illustrative purposes, the present disclosure is described by referring mainly to an exemplary embodiment thereof. In the following description, numerous specific details are set forth in order to provide a thorough understanding of the present disclosure. However, it will be readily apparent to one of ordinary skill in the art that the present disclosure may be practiced without limitation to these specific details.

In this disclosure, systems and methods of converting a cornhole game to a horseshoe game are provided. FIGS. 1A-E illustrate one embodiment of a system 100 of converting a cornhole game to a horseshoe game in accordance with various aspects as described herein. In FIGS. 1A-E, the system 100 includes a horseshoe apparatus 101 and a cornhole apparatus 121. The cornhole apparatus 121 includes an inclined platform 123, a bag receiving hole 125 disposed in the inclined platform 123, and legs 127. In playing the cornhole game using the cornhole apparatus 121, the hole 125 is operable to receive a bag tossed therein. FIGS. 2A-E further illustrates the horseshoe apparatus 101. The horseshoe apparatus 101 includes an outer base 103, an inner base 105, a coupling mechanism 107, and a stem 109. The outer base 103 has upper and lower surfaces. The diameter or dimensions of the outer base 103 is greater than a diameter or dimensions of the hole 121 so that the outer base 103 is operable to be positioned over the hole 121 and on a portion of the outer surface of the inclined platform 123. Further, the perimeter of the outer base 103 has a beveled edge so that objects tossed towards the stem 109 can slide from the inclined platform 123 onto the outer base 103. In one example, the beveled edge has an angle of no more than forty-five degrees (45°). In another example, the beveled edge has an angle of thirty degrees (30°). In another example, the beveled edge has an angle in a range from twenty to forty degrees (20° to 40°). The stem 109 can be disposed in an aperture 104 of the outer base 103, an aperture 106 of the inner base 105, and an aperture of the coupling mechanism 107.

In the current embodiment, the inner base 105 has upper and lower surfaces. The upper surface of the inner base 105 is centrally coupled to the lower surface of the outer base 103. Further, the inner base 105 includes a first fitting mechanism 110 that is attached to the side of the inner base 105. The first fitting mechanism 110 is configured to fit the sides of the inner base 105 to the perimeter of the hole 125 when the inner base 105 is disposed in the hole 125. When the circumference or width of the inner base 105 is equivalent to the circumference or width of the hole 125, then the first fitting mechanism 110 is not required or may be configured to be flush with or below the side surface of the inner base 105. When the circumference or width of the inner base 105 is less than the circumference or width of the hole 125, then the first fitting mechanism 110 is configured to fit the sides of the inner base 105 to the perimeter of the hole 125 when the inner base 105 is disposed in the hole 125. In one example, the first fitting mechanism 110 (e.g., screw) is configured to be rotated to extend or retract the first fitting mechanism 110 from the side of the inner base 105 such that the first fitting mechanism 110 can be rotated to the appropriate depth to fit the inner base 105 to the hole 125. In another example, the first fitting mechanism 110 is configured to be attached to the side of the inner base 105.

Furthermore, the first fitting mechanism 110 may include a plurality of fitting mechanisms having different depths such that the fitting mechanism having the appropriate depth can be attached to the side of the inner base 105 to fit the inner base 105 to the hole 125. The diameter or dimensions of the inner base 105 is no more than the diameter or dimensions of the hole 125. Further, the depth of the inner base 105 is at least a depth of the hole 125. The coupling mechanism 107 has first and second ends. The coupling mechanism 107 is coupled to the lower surface of the inner base 105 such that the first end is positioned to extend outside a perimeter of the inner base 105 and the second end is positioned within the perimeter of the inner base 105. The first end may have a beveled edge 113 to allow for more easy installation of the horseshoe apparatus 121 onto the cornhole apparatus 121. In one example, this beveled edge has an angle of forty-five degrees (45°). In another example, the beveled edge has an angle in a range from thirty to sixty degrees (30° to 60°).

In this embodiment, the coupling mechanism 107 includes a second fitting mechanism 112 that is attached to the upper surface of the coupling mechanism 107. In one example, the second fitting mechanism 107 may be positioned on the portion of the upper surface of the coupling mechanism 107 that is outside the perimeter of the outer base 103. The second fitting mechanism 112 is configured to fit the coupling mechanism 107 to the inner surface of the inclined platform 123 when the inner base 105 is disposed in the hole 125. When the depth of the inner base 105 is equivalent to the depth of the hole 125, then the second fitting mechanism 112 is not required or may be configured to be flush with or below the upper surface of the coupling mechanism 107. When the depth of the inner base 105 is greater than the depth of the hole 125, then the second fitting mechanism 112 is configured to fit the coupling mechanism 107 to the inner surface of the inclined platform 123 when the inner base 105 is disposed in the hole 125. In one example, the second fitting mechanism 112 (e.g., screw) is configured to be rotated to extend or retract the second fitting mechanism 112 from the upper surface of the coupling mechanism 107 such that the second fitting mechanism 112 can be rotated to the appropriate depth to fit the coupling mechanism 107 to the inner surface of the inclined platform 123. In another example, the second fitting mechanism 112 is configured to be attached to the upper surface of the coupling mechanism 107. Further, the second fitting mechanism 112 may include a plurality of second fitting mechanisms having different depths such that the second fitting mechanism having the appropriate depth can be attached to the upper surface of the coupling mechanism 107 so as to fit the coupling mechanism 107 to the inner surface of the inclined platform 123. The stem 109 is disposed through and at the center of the outer base 103. The stem 109 is operable to deflect or catch an object tossed towards the stem 109.

FIGS. 3A-D illustrate one embodiment of a horseshoe bag assembly 300 in accordance with various aspects as described herein. In FIGS. 3A-D, the bag assembly 300 includes a housing 301, a rigid form 303 and filler 305. The housing 301 may be composed of a fabric or other like material. The rigid form 303 is disposed in the housing 301 and operable to maintain the form of the assembly 300 while playing horseshoes using the converted horseshoe game. The rigid form 303 has a shape that defines all or a portion of the periphery of the bag assembly 300. The rigid form may be composed of a metal, plastic, wood, the like, or any combination thereof. Further, the rigid form 303 enables the bag assembly 300 to be thrown for a ringer. In one example, a ringer occurs when the bag assembly 300 has been thrown in such a way as to completely encircle the stem 109 of the horseshoe apparatus 101. A skilled artisan will readily recognize the application of the term ringer to the horseshoe game described herein. The filler 305 is also disposed in the housing 301 to provide shape, form and weight to the housing 301. In one definition, the filler 305 is a material (e.g., corn, pellets, or the like) used to fill gaps in the housing 301.

Figure 4:
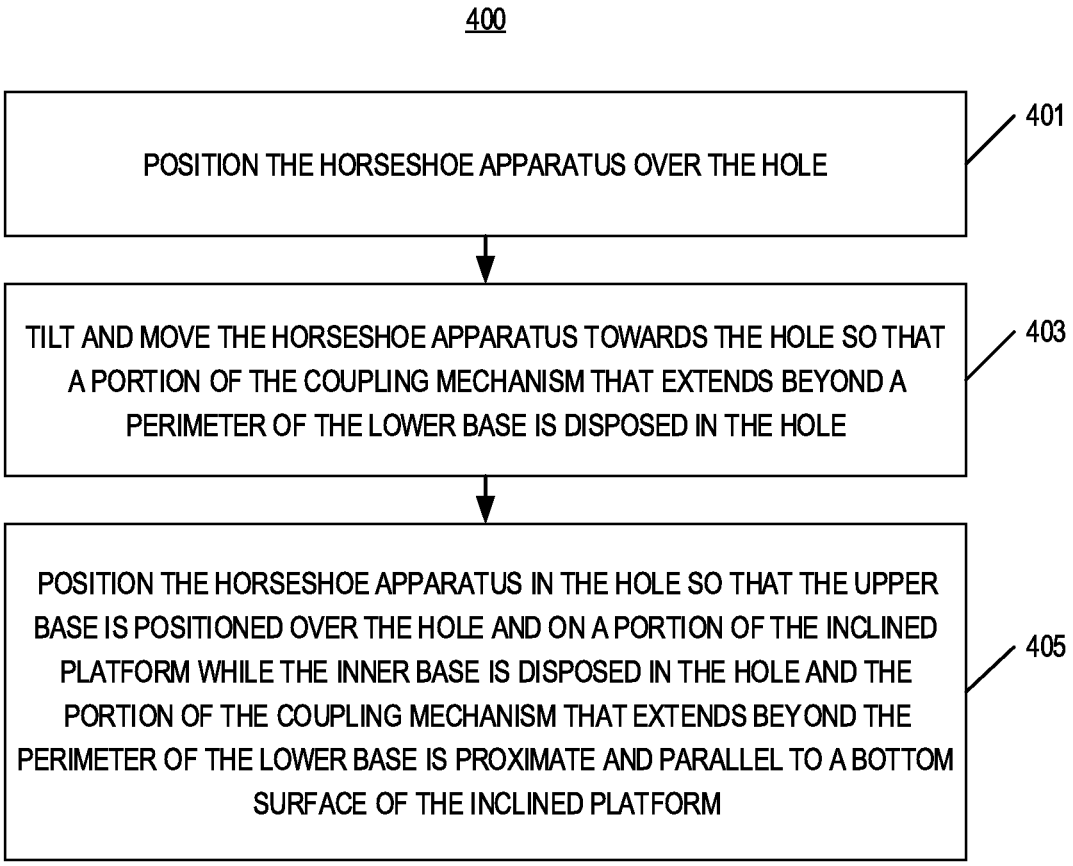
FIG. 4 illustrates one embodiment of a method of converting a cornhole game to a horseshoe game in accordance with various aspects as described herein.

FIG. 4 illustrates one embodiment of a method 400 of converting a cornhole game to a horseshoe game in accordance with various aspects as described herein. In FIG. 4, the method 400 may start at block 401 where it includes positioning the horseshoe apparatus over the hole. At block 403, the method 400 includes tilting and moving the horseshoe apparatus towards the hole so that a portion of the coupling mechanism that extends beyond a perimeter of the lower base is disposed in the hole. At block 405, the method 400 includes positioning the horseshoe apparatus in the hole so that the upper base is positioned over the hole and on a portion of the inclined platform while the inner base is disposed in the hole and the portion of the coupling mechanism that extends beyond the perimeter of the lower base is proximate and parallel to a bottom surface of the inclined platform.

The previous detailed description is merely illustrative in nature and is not intended to limit the present disclosure, or the application and uses of the present disclosure. Furthermore, there is no intention to be bound by any expressed or implied theory presented in the preceding field of use, background, summary, or detailed description. The present disclosure provides various examples, embodiments and the like, which may be described herein in terms of functional or logical block elements. The various aspects described herein are presented as methods, devices (or apparatus), systems, or articles of manufacture that may include a number of components, elements, members, modules, nodes, peripherals, or the like. Further, these methods, devices, systems, or articles of manufacture may include or not include additional components, elements, members, modules, nodes, peripherals, or the like.

Throughout the specification and the embodiments, the following terms take at least the meanings explicitly associated herein, unless the context clearly dictates otherwise. Relational terms such as "first" and "second," and the like may be used solely to distinguish one entity or action from another entity or action without necessarily requiring or implying any actual such relationship or order between such entities or actions. The term "or" is intended to mean an inclusive "or" unless specified otherwise or clear from the context to be directed to an exclusive form. Further, the terms "a," "an," and "the" are intended to mean one or more unless specified otherwise or clear from the context to be directed to a singular form. The term "include" and its various forms are intended to mean including but not limited to. References to "one embodiment," "an embodiment," "example embodiment," "various embodiments," and other like terms indicate that the embodiments of the disclosed technology so described may include a particular function, feature, structure, or characteristic, but not every embodiment necessarily includes the particular function, feature, structure, or characteristic. Further, repeated use of the phrase "in one embodiment" does not necessarily refer to the same embodiment, although it may. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. A device or structure that is "configured" in a certain way is configured in at least that way, but may also be configured in ways that are not listed.

What is claimed is:

1. A horseshoe apparatus that is operable to be disposed in a bag receiving hole in an inclined platform of a cornhole apparatus so as to couple the horseshoe apparatus to the cornhole apparatus to enable a horseshoe game, comprising:

an outer base having upper and lower surfaces, with a diameter or dimensions of the outer base being greater than a diameter or dimensions of the hole so that the outer base is operable to be positioned over the hole and on a portion of the inclined platform;

an inner base having upper and lower surfaces and a first fitting mechanism, wherein the upper surface of the inner base is centrally coupled to the lower surface of the outer base, with a diameter or dimensions of the inner base being no more than the diameter or dimensions of the hole and a depth of the inner base being at least a depth of the hole, wherein the first fitting mechanism is attached to a side of the inner base and configured to engage a perimeter of the bag receiving hole;

a coupling mechanism having a shape of a rectangle and first and second ends with the first end having a beveled edge, wherein a portion of an upper surface of the coupling mechanism that is towards the second end is coupled to a portion of the lower surface of the inner base such that the first end of the coupling mechanism is positioned outside a perimeter of the inner base and the second end of the coupling mechanism is positioned within the perimeter of the inner base, wherein the coupling mechanism includes a second fitting mechanism coupled to a portion of an upper surface of the coupling mechanism that is towards the first end of the coupling mechanism, the second fitting mechanism being configured to engage a portion of a lower surface of the inclined platform; and a stem is disposed in an aperture of the outer base that is positioned at a center of the outer base, wherein the stem is operable to deflect or catch an object tossed towards the stem.

2. The apparatus of claim 1, wherein each of the outer and inner bases has a shape of a cylinder.

3. The apparatus of claim 1, wherein the stem has a shape of a cylinder.

4. The apparatus of claim 1, wherein the stem is further disposed in an aperture of the inner base that is positioned at a center of the inner base.

5. The apparatus of claim 4, wherein the stem is further disposed in an aperture of the coupling mechanism that is towards the second end of the coupling mechanism.

6. The apparatus of claim 1, wherein the coupling mechanism is a shape of a rectangular prism.

7. The apparatus of claim 1, wherein the perimeter of the outer base has a beveled edge.

8. The apparatus of claim 7, wherein an angle of that beveled edge is no more than forty-five degrees.

9. The apparatus of claim 1, wherein the beveled edge of the first end of the coupling mechanism is tapered between the upper surface and the lower surface of the first end of the coupling mechanism.

10. The apparatus of claim 9, wherein an angle of that beveled edge is forty-five degrees.

11. A method of installing a horseshoe apparatus in a bag receiving hole in an inclined platform of a cornhole apparatus to enable the playing of horseshoes, comprising:

providing the horseshoe apparatus of claim 1, positioning the horseshoe apparatus over the hole, tilting and moving the horseshoe apparatus towards the hole so that a portion of the coupling mechanism that extends beyond the perimeter of the inner base is disposed in the hole; and positioning the horseshoe apparatus in the hole so that the outer base is positioned over the hole and on the portion of the inclined platform, the inner base is disposed in the hole, the first fitting mechanism extends toward and engages the perimeter of the bag receiving hole, the portion of the coupling mechanism that extends beyond the perimeter of the inner base is proximate and parallel to the lower surface of the inclined platform, and the second fitting mechanism extends toward and engages the lower surface of the inclined platform.

12. The method of claim 11, wherein each of the outer and inner bases has a shape of a cylinder.

13. The method of claim 11, wherein the stem has a shape of a cylinder.

14. The method of claim 11, wherein the stem is further disposed through and at a center of the inner base.

15. The method of claim 14, wherein the stem is further disposed in an aperture of the coupling mechanism that is towards the second end of the coupling mechanism.

16. The method of claim 11, wherein the coupling mechanism is a shape of a rectangular prism.

17. The of method claim 11, wherein the perimeter of the outer base has a beveled edge.

18. The method of claim 17, wherein an angle of that beveled edge is no more than forty-five degrees.

19. The method of claim 11, wherein the first end of the coupling mechanism has a beveled edge.

20. The method of claim 19, wherein an angle of that beveled edge is forty-five degrees.

* * * * *